United States Patent [19]

Ahrens et al.

[11] Patent Number: 4,774,996

[45] Date of Patent: Oct. 4, 1988

[54] MOVING PLATE CONTINUOUS CASTING AFTERCOOLER

[75] Inventors: Max Ahrens; Manfred Haissig, both of Irvine, Calif.

[73] Assignee: Steel Casting Engineering, Ltd., Orange, Calif.

[21] Appl. No.: 913,077

[22] Filed: Sep. 29, 1986

[51] Int. Cl.[4] ..... B22D 11/124

[52] U.S. Cl. ..... 164/443; 164/418; 164/440; 164/436

[58] Field of Search ..... 164/418, 435, 436, 440, 164/443, 444, 485, 486, 490, 491

[56] References Cited

U.S. PATENT DOCUMENTS

| | | | |
|---|---|---|---|
| 3,082,496 | 3/1963 | Bungeroth et al. | 164/435 |
| 3,545,530 | 12/1970 | Ciochetto | 164/490 |
| 4,580,614 | 4/1986 | Haissig | 164/443 |

FOREIGN PATENT DOCUMENTS

| | | | |
|---|---|---|---|
| 57-47557 | 3/1982 | Japan | 164/418 |
| 58-151944 | 9/1983 | Japan | 164/436 |
| 102995 | 11/1941 | Sweden | 164/443 |

*Primary Examiner*—Nicholas P. Godici
*Assistant Examiner*—Richard K. Seidel
*Attorney, Agent, or Firm*—Roy A. Ekstrand

[57] ABSTRACT

A moving plate aftercooler for use in a continous casting system includes a plurality of cooling plates having means for circulation of coolant therethrough arranged in a serially overlapping configuration in which the plates are individually moveable to accomodate variations of the casting. Hydraulic means are operative upon the cooling plates to assert a contact force and hold the cooling plates in contact with the surfaces of the casting. The individual plate motions provide for accomodation of the taper of the cooling casting. A serial arrangement of three aftercoolers which cooperate to provide a continuous partially flexible cooling passage is also shown.

11 Claims, 2 Drawing Sheets

MOVING PLATE CONTINUOUS CASTING AFTERCOOLER

CROSS REFERENCE TO RELATED PATENT APPLICATIONS

This application discloses apparatus described and claimed in the following related applications, each of which is assigned to the assignee of this application:

1. Ser. No. 06/913,022, filed Sept. 29, 1986 and entitled: Continuous Casting Extended Throat and Tailheater.
2. Ser. No. 06/913,504, filed Sept. 29, 1986 and entitled: Short Mold for Continuous Casting.

FIELD OF THE INVENTION

This invention relates generally to continuous casting systems in which a single elongated casting is formed and particularly to horizontal continuous casting systems requiring post mold aftercoolers having substantial heat transferring capability.

BACKGROUND OF THE INVENTION

The continuous casting system provides a system of casting fabrication in which a supply of molten metal or metal alloy is heated and liquified within a furnace-like structure called a tundish or heated outside the tundish and placed therein prior to casting. In most systems the furnace includes a discharge orifice near the bottom of its internal cavity which is coupled by a throat to a cooled die or mold. The latter defines an elongated die passage suitable for the formation of an elongated casting which in turn defines an entrance opening and an exit opening. In addition, cooling means are provided which generally encircle or surround the die passage for the purpose of conducting sufficient heat from the molten metal within the die passage to solidify all or part of the molten metal therein and form the casting. Continuous casting systems may comprise either vertical or horizontal casters.

Vertical casting systems are generally used to form large billet and slab castings and acquire their name from the vertical casting path. The furnace and cooled mold are arranged vertically and gravity flows the molten metal into and through the mold. In most vertical casting systems, an array of drive rollers beneath the mold control the downward motion of the casting. In many vertical casting systems a gradual curve is introduced into the casting to transition it from a vertical path to a horizontal path in order to reduce the overall height of the casting system.

In horizontal continuous casting systems, the furnace, called a tundish, and the cooled die, also called a mold, are horizontally aligned and drive means are provided downstream of the mold which are operative upon the casting to periodically withdraw a portion of the casting from the die passage. The speed at which the casting is withdrawn from the cooled die is selected in accordance with the cooling capacity of the die and characteristics of the casting to ensure that the emerging casting is solidified on its outer surfaces to a sufficient extent that the forces imparted by the drive system do not cause the casting to be overstressed and damaged.

In both horizontal and vertical casting systems, the casting of thicker casting configurations results in withdrawing the casting before complete solidification has taken place in the mold. As a result, the casting emerging from the cooled die passage has a solidified outer skin with a molten center. The molten center is generally tapered from a maximum cross-section near the casting's emergence from the cooled mold to a minimum at the point of complete solidification of the casting. The distance from the input orifice of the cooled mold to the point of complete solidification of the casting is known as the "metallurgical length". For reasons which are well-known in the art, the casting quality is improved as the metallurgical length is shortened. That is to say, with shorter metallurgical length and the faster cooling which produces it, the average grain size within the casting is finer, which is the desired characteristic. In addition, a shorter metallurgical length minimizes the formation of internal voids and permits the rolling stages of the casting system to be located closer to the mold thereby reducing the length of the casting system. In addition to the need to cool the casting which arise in attempts to reduce metallurgical length, another problem arises because of great heat present in the molten center. The casting skin must be cooled after the casting emerges from the cooled die to prevent the casting skin from being melted by the heat present in the molten metal within the casting. This problem, known as "remelting", is avoided by utilizing either or both of two basic cooling systems. The first, uses a long cooled die or mold having sufficient capacity to withdraw substantially more heat from the casting than is required to form the above-described skin. The use of a long casting mold or cooled die provides some additional cooling of the casting. However, a problem arises in both vertical and horizontal continuous casting process caused by shrinkage of the casting as cooling takes place. This shrinkage tends to distribute itself down the casting and result in a reduced cross-sectional area and surface area of the casting as a function of distance from the tundish. In essence, the casting assumes a "tapered shape". In most castings, the casting taper is sufficient to cause an air space to be created between the casting skin and the cooling surfaces of the cooled die passage as the casting "shrinks" away from the passage walls. Once the contact between the passage walls and the casting surface is broken, the cooling of that area of the casting is decreased reducing overall cooling and creating "hot spots" in the casting. In addition, because some portions of the casting remain in contact with the die passage and are cooled more rapidly than those no longer in contact, uneven cooling results which degrades casting quality and often causes the casting to warp. Practitioners in the art have attempted to compensate for casting shrinkage by simply constructing the die passage to include a carefully designed taper which gradually narrows the die passage as a function of distance from the entrance orifice or tundish.

The use of tapered die passages within the mold structures provides some improvement in the ability of the cooled die to compensate for the shrinkage of the casting. However, because each casting configuration and size and each metal or metal alloy used requires a different shrinkage taper, the mold or cooled die taper must be customized for each application. This leads to increased fabrication and tooling costs which are prohibitive in a competitive environment. In addition, for each casting and metal or metal alloy cast, the passage taper is fitted to a casting stroke, speed and superheat. Therefore, the casting stroke and speed must be inordinately controlled. Further, tapered molds or dies are less tolerant of wear due to the precision required of the taper.

The second approach utilizes one or more casting cooling devices known as secondary spray cooling zones located in the downstream portion of the casting path near its emergence from the cooled die which are operative to withdraw further heat from the casting. In the majority of the present systems, such secondary spary coolers comprise a plurality of water spray devices which direct water streams or air and water mist at the emerging casting intended to carry heat from the casting surface.

Generally, such secondary spray coolers are only partially effective however, and often produce large quantities of steam which require collection and are sensitive and difficult to maintain. As a result, many practitioners in the casting art have been forced to use longer casting dies and live with the difficulties and increased costs associated with extended cooling dies and water spray coolers. Other practitioners have attempted to construct aftercoolers having greater effectiveness than the conventional spray coolers heretofore used in the hope of avoiding the need for spray coolers. Prior attempts at improving aftercooler effectiveness include the provision of aftercoolers which are in essence similar to the cooled die which originally formed the casting. As such, these aftercoolers must compensate for the shrinkage and are therefore tapered to match the inherent taper of the cooling casting. Recognizing the difficulties and limitations of tapered passage aftercoolers, other practitioners in the art have attempted to provide aftercoolers having walls which are moveable to accommodate the variations in casting taper and thus avoid the expenses and difficulties of custom designed tapered equipment for each application.

Prior attempts at providing aftercoolers having wall structures which accomodate a variety of casting tapers have resulted in structures which are only partial solutions in that they contact only portions of the casting surface. Such systems, as shown and described in U.S. Pat. No. 3,580,327, U.S. Pat. No. 4,308,774, and U.S. Pat. No. 3,467,168, provide structures which contact only portions of the casting surface. While such structures provide an improvement in aftercooler design, they do not provide a casting encompassing passage way which automatically interracts with the casting so as to contact the entire casting surface including its corners. As is well understood by those skilled in the casting art, complete contact with the entire casting surface including its corners is essential to the attainment of even cooling of the entire casting in order to provide the desired casting uniformity and grain structure as well as prevention of the remelt phenomenon.

In addition to problems associated with the taper of the casting, all molds and aftercoolers, regardless of design, are subject to substantial wear as the heated casting is moved through the structure. In the case of fixed tapered molds in particular, such wear quickly renders the taper inappropriate for proper cooling of the casting. To a lesser extent but still nonetheless significant, cooling structures utilized as aftercoolers in which some of the cooling walls are moveable often result in unequal wear between the moveable and fixed walls. This of course produces a corresponding deterioration in the ability of the device to accommodate casting taper.

The problem of constructing aftercoolers is further exaserbated by the structure of the cooler walls themselves. In the majority of such aftercooler devices, the walls are multi-layered combinations of elements. Each includes an interior surface selected to provide reduced friction, such as graphite, and a backing plate selected for its strength and heat transfer capabilities, such as copper, together with an outer plate generally comprising a rigid steel mounting plate selected for strength and rigidity. One or more coolant passages for circulating a liquid coolant are formed in the copper backing plate and the steel mounting plate.

While the above-described prior art structures have provided some improvement in casting cooling and a partial solution to the problem of accommodating casting tapers, they have not as yet provided aftercooler structures in which the casting taper is accommodated in a manner whereby the aftercooler maintains contact with the entire surface of the casting including its corners. There remains therefore, a need in the art for an improved aftercooler for use in continuous casting systems which maintains contact with the entire surface of the emerging casting and which accommodates the varying tapers of the cooling casting while maintaining surface contact.

SUMMARY OF THE INVENTION

Accordingly, it is a general object of the present invention to provide an improved aftercooler for use in the continous casting process. It is a more particular object of the present invention to provide an improved aftercooler for use in the continous casting process which maintains the contact between the entire outer surface of the casting and the cooling surfaces of the aftercooler despite shrinkage and taper of the casting. It is a still further object of the present invention to provide an improved aftercooler for use in a continuous casting system which maintains cooling surface contact with each of the corners of the casting.

In accordance with the present invention, there is provided an aftercooler adapted to receive and cool a continuously formed casting of metal or metal alloy in which a plurality of moveable cooling plates are arranged to form a passage through which the casting passes as it emerges from the cooled die. Each of the plates accommodates a cooling apparatus for removing heat from the casting. The moveable plates are so arranged relative to each other as to permit them to move relative to each other to alter the cross-sectional size of the passage way defined by the interiors of such plates and thereby maintain contact with all portions of the periphery of the casting and compensate for any shrinkage thereof. Means are provided which are operative upon the plates to apply a predetermined inward force thereto and cause the plates to be biased into engagement with the underlying portion of the periphery of the casting.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 3A, 3B, 3C, 3D:
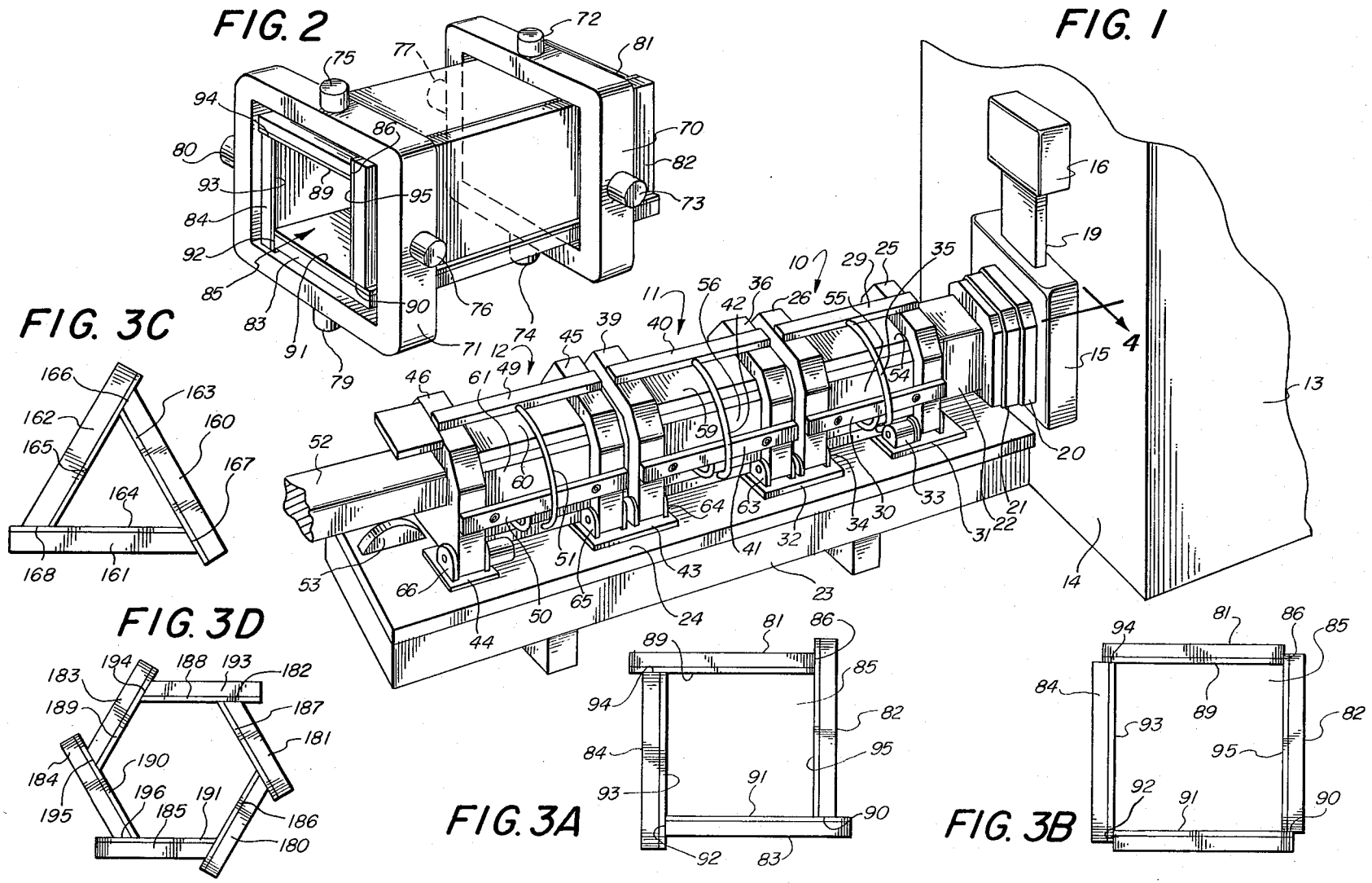
FIG. 1 is a perspective view of a horizontal continuous casting system utilizing several moving plate continuous casting aftercoolers constructed in accordance with the present invention.
FIG. 2 is a simplified perspective view of a moving plate continuous casting aftercooler constructed in accordance with the present invention.
FIGS. 3A and 3B are section views of the cooling plate portions of the present invention moving plate continuous casting aftercooler taken along section lines 3—3 in FIG. 2.
FIGS. 3C and 3D are section views of triangular and hexagonal embodiments of the present invention moving plate continuous casting aftercooler.

FIG. 1 sets forth a perspective view of a horizontal continuous casting system constructed in accordance with the present invention having a tundish 13 which provides a source of molten metal for use in the casting process. A slide gate 15, which may be constructed in accordance with conventional continuous casting principals, is coupled to a slide gate activator 16 by a slide gate coupling 19, all of which are supported on a front surface 14 of tundish 13. Slide gate 15 defines an internal passage (better shown in FIG. 4) which may be selectively opened or closed by the cooperation of slide gate 15, slide gate coupling 19 and slide gate activator 16. The operation of slide gates of the type represented by slide gate 15 are well known in the continuous casting art and take many forms. However, suffice it to note here that slide gate 15 provides an operable passage which, when opened, permits molten metal within tundish 13 to flow through slide gate 15 and commence the casting process. During the casting process itself, slide gate 15 is maintained in the open position to permit a substantially continuous flow of molten metal from the interior of tundish 13. A retainer 20 and a copper mold 21 are coupled together, and by means of retainer 20, copper mold 21 is secured to slide gate 15. A plate recooler 22 is coupled to the output side of copper mold 21. It should be noted that the structure of copper mold 21 and plate recooler 22 are described in detail in the above-referenced related patent applications and while the use of the structures shown in advantageous and preferred, the aftercoolers of the present invention may be used with other more conventional mold structures. A trio of moving plate aftercoolers 10, 11 and 12 of substantially identical construction and each constructed in accordance with the present invention, are serially coupled to the output of plate recooler 22. It should be understood that slide gate 15, copper mold 21, plate recooler 22 and aftercoolers 10, 11 and 12 each define respective internal passages (better seen in FIG. 4) which are in precise axial alignment and therefore cooperate to form a substantially continuous passage from the interior of tundish 13 to the output of the final aftercooler 12.

Aftercooler 10 comprises a pair of vertical support frames 25 and 26 which are substantially parallel and spaced apart from each other. A plurality of cross supports, including cross supports 29 and 30, as well as an additional cross support similar to cross support 30 positioned on the reversed side of aftercooler 10 and therefore not visible in FIG. 1, are secured to frames 25 and 26 and serve to maintain the spacing therebetween. A pair of base members 31 and 32 are secured to frames 25 and 26 respectively by frame attachments 33 and 34. A casting bed 33 defines a support surface 24 to which bases 31 and 32 are secured. A plurality of cooling plates, including cooling plates 54 and 55, are secured to and supported by frames 25 and 26 by means described below in greater detail. It should be understood that aftercooler 10 includes, in the embodiment shown, a total of four cooling plates, two of which are not visible in FIG. 1 due to the perspective view, but which are arranged similar to cooling plates 81 through 84 in FIG. 2.

By means set forth below in greater detail, hydraulic means within frames 25 and 26 are operative upon the cooling plates of aftercooler 10, including cooling plates 54 and 55, to maintain cooling plate contact with the forming casting within the internal cating passage of aftercooler 10. passage. Cross supports 29 and 30 each define internal hydraulic fluid passages (not shown) which are coupled to the hydraulic means within frames 25 and 26 operative upon the cooling plates of aftercooler 10. A hydraulic line 35 provides a supply of hydraulic fluid under pressure to the cross supports of aftercooler 10.

Aftercooler 11 is constructed in substantial identity to aftercooler 10 and defines a pair of vertical support frames 36 and 39 and a plurality of cross supports, including cross supports 40 and 41 as well as a cross support on the opposite side of aftercooler 11 and positioned similar to cross support 41 coupled therebetween, to form a rigid aftercooler frame structure. A hydraulic line 42 interconnects the cross supports of aftercooler 11 to provide a flow of hydraulic fluid under pressure to activate the hydraulic means within frames 36 and 39. Aftercooler 11 includes a plurality of cooling plates, including cooling plates 56 and 59 seen in FIG. 1 which are arranged in the same position as cooling plates 81 through 84 in FIG. 2.

Aftercooler 12 is substantially identical in construction to aftercoolers 10 and 11 and includes a pair of vertical frame supports 45 and 46 and a plurality of cross supports, including cross supports 49 and 50, coupled therebetween to form a rigid aftercooler support structure. A hydraulic line 51 provides fluid coupling to cross supports 49 and 50 and a plurality of cooling plates, including cooling plates 60 and 61 visible in FIG. 1, are arranged in the arrangement of cooling plates 81 through 84 shown in FIG. 2.

Frame 36 is secured to base 32 by a frame attachment 63. It should be noted that the common attachment to base 32 of frame 26 of aftercooler 10 and frame 36 of aftercooler 11 is operative to maintain the alignment of aftercoolers 10 and 11. A base 43 is secured to support surface 24. Frames 39 and 45 of aftercoolers 11 and 12 respectively are attached to base 43 in an attachment which is operative to maintain the alignment between aftercoolers 11 and 12. Similarly, base 44 is secured to support surface 24 and frame 46 of aftercooler 12 is attached to base 44 by a frame attachment 66. Frames 39 and 45 are secured to base 43 by frame attachment 64 and 65 respectively. Support surface 24 supports a roller 53 the function of which is set forth below.

In operation, molten metal within the interior of tundish 13 is caused to flow through slide gate 15 and into copper mold 21. Within mold 21, the initial cooling of the exterior surfaces of the forming casting is carried forward in accordance with conventional continuous casting processes. In accordance with such continuous casting processes, a solidified skin forms upon the casting exterior surfaces in contact with the interior of copper mold 21 and is further cooled by plate recooler 22. The forming casting thereafter passes through the casting passages of aftercoolers 10, 11 and 12 and emerges as casting 52. Roller 53 provides a partial support for casting 52 as it is withdrawn from aftercooler 12. As mentioned, copper mold 21 and plate recooler 22 comprise the structure entitled Short Mold For Continuous Casting set forth in the above-referenced application. It should be apparent however, that the present invention aftercoolers may be utilized with differing mold structures without departing from the spirit and scope of the present invention.

Figure 4:
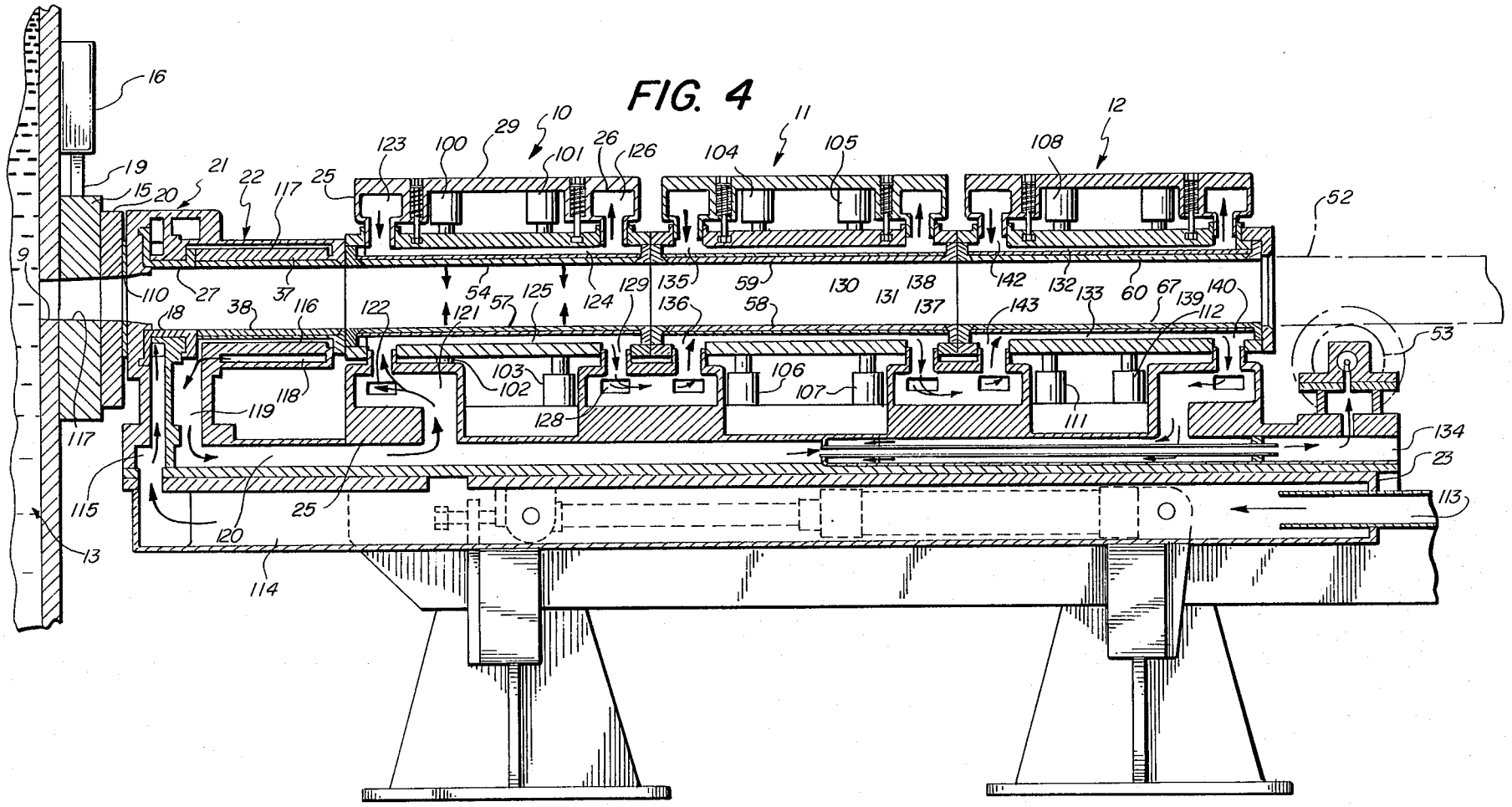
FIG. 4 is a longitudinal cross-section of the horizontal continuous casting system and moving plate continuous casting aftercoolers taken along section lines 4—4 in FIG. 1.

In accordance with an important aspect of the present invention, and by means set forth below in greater detail, aftercooler 10 is operative upon casting 52 to maintain contact between the outer surfaces of casting 52 and the aftercooler cooling plates, such as cooling plates 54 and 55, and to adjust for shrinkage and other changes such as taper which casting 52 undergoes. Aftercoolers 11 and 12 function individually in the same manner as aftercooler 10 in that they include a quartet of moveable cooling plates which are influenced under the hydraulic mechanisms of the aftercoolers to maintain surface contact with casting 52. In addition, the serial arrangement of aftercoolers 10, 11 and 12 provides an overall ability of the combination of aftercooler structure which they represent in their serial coupling to adjust for curvature and twisting of casting 52 as it emerges from plate recooler 22 and passes through the aftercoolers. Simply stated, the individual sets of cooling plates within aftercoolers 10, 11 and 12 cooperate to maintain contact between the aftercooler cooling plates and the casting surfaces which approximates that provided by a flexible cooling passage. In other words, as one aspect of system design in the present invention system, the length and number of aftercoolers is selected to assure that the aftercooler plates follow the variations in casting taper rather than span or bridge such variations in order to avoid creating spacings between the casting surface and the plates. In addition, and in accordance with means set forth below in greater detail, the movement of cooling plates within aftercoolers 10, 11 and 12, provide compensation for the above-described taper of casting 52 during the cooling process. While three aftercoolers are shown in FIGS. 1 and 4, it will be apparent that other numbers of aftercoolers may be serially coupled together without departing from the spirit and scope of the present invention.

FIG. 2 is a perspective view of a simplified embodiment of the present invention aftercooler configured to receive a square or rectangular cross sectioned casting in which several operative components of the structure have been omitted to facilitate description of the cooperation between the cooling plates and hydraulic actuators of the present invention moving plate aftercooler. Accordingly, it should be understood that FIG. 2 is set forth primarily to illustrate the operative principles of the present invention and does not therefore attempt to disclose a complete operative structure. A cooling plate 81 comprises a substantially planar rectangular plate member defining an interior cooling surface 89 and a precision machined plate edge 86 extending for the entire length of cooling plate 81. A cooling plate 82 comprises a substantially rectangular flat plate defining a flat interior cooling surface 95 and a machined plate edge 90 extending its entire length. A cooling plate 83 comprises a substantially rectangular flat plate defining a flat interior cooling surface 91 and a machined plate edge 92 extending its entire length. A cooling plate 84 comprises a substantially rectangular flat plate defining a cooling surface 93 and a precision machined plate edge 94 extending its entire length. In their preferred construction, cooling plates 81 through 84 comprise copper plates which are cooled by coolant passages (better seen in FIG. 4) and cooling surfaces 89, 95, 91 and 93 comprise layers of graphite material secured to the cooling plates. Cooling plates 81 through 84 are arranged such that cooling surfaces 89, 95, 91 and 93 are all inwardly facing to surround a casting passage 85. In addition, cooling plates 81 through 84 are arranged to form a rectangular casting passage in that cooling plate 81 is mutually perpendicular to cooling plates 84 and 82 and is parallel to cooling plate 83. Accordingly, the intersection of plates 81 and 82 at plate edge 86 forms a right angle. Similarly, the intersection of plates 82 and 83 at plate edge 90 form a right angle and cooling plate 83 forms a right angle with cooling plate 84 while cooling plate 84 forms a right angle with cooling plate 81.

A frame 70 encircles cooling plates 81 through 84 and supports a quartet of hydraulic cylinders 72, 73, 74 and 77 each positioned overlying cooling plates 81, 82, 83 and 84 respectively. A second frame 71 is spaced from frame 70 and encircles cooling plates 81 through 84. Frame 71 supports a second quartet of hydraulic cylinders 75, 76, 79 and 80 overlying cooling plates 81 through 84 respectively. In accordance with an important aspect of the present invention, hydraulic cylinders 72, 73, 74 and 77 are operative upon one end of cooling plates 81 through 84 respectively, while hydraulic cylinders 75, 76, 79 and 80 are operative upon the other end of cooling plates 81 through 84 respectively. Accordingly, as will be described below in greater detail, the cross-section of casting passage 85 may be independently adjusted at each end of the structure. In accordance with another important aspect of the present invention, it should be noted that machined plate edge 86 and cooling surface 95 are fabricated to produce a seal therebetween notwithstanding motion of plate edge 86 with respect to cooling surface 95. Similarly, plate edge 90 and cooling surface 91 form a sealing contact as does plate edge 92 with cooling surface 93 and plate edge 94 with cooling surface 89.

In addition, it will be apparent to those skilled in the art that while hydraulic cylinders are shown in the preferred embodiments described below, other expansion devices may be utilized to move the cooling plates without departing from the present invention. For example, the hydraulic cylinders may be pneumatically operated cylinder or even hydraulic cylinders in which water is used in place of oil. By way of further example, mechanical force means such as springs, may be utilized to derive the cooling plates against the casting surfaces.

In operation, hydraulic cylinders 75 and 72 are operative upon cooling plate 81 to force cooling plate 81 inward, that is toward cooling plate 83, until cooling surface 89 uniformly contacts the underlying casting surface. Similarly, hydraulic cylinders 73 and 76 are operative upon cooling plate 82 to force it inwardly toward cooling plate 84 until cooling plate 82 uniformly contacts the underlying surface of the casting within casting passage 85. By further similarity, cooling plate 83 is forced upwardly toward cooling plate 81 by the operation of hydraulic cylinders 76 and 79 until cooling surface 91 uniformly contacts the underlying surface of the casting. Finally, cooling plate 84 is forced inwardly toward cooling plate 82 by the action of hydraulic cylinders 77 and 80 until cooling surface 93 uniformly contacts the underlying casting surface.

FIGS. 3A and 3B illustrate the accommodation of casting size variations of the present invention aftercooler. Turning to FIG. 3A, it should be noted that cooling plate 81 extends beyond plate edge 94, while cooling plate 82 extends beyond plate edge 86, and cooling plates 83 and 84 extend beyond plate edges 90 and 92 respectively. The position shown in FIG. 3A therefore, is representative of an inward accommodation of the present invention aftercooler such as would take place to maintain cooling plate contact with a casting of reduced size. Such as occurs for example in the above-described casting shrinkage during cooling. Conversely, FIG. 3 shows the position of cooling plates 81 through 84 as they appear when the present invention aftercooler has been forced to expand to accommodate a larger cross-section casting. It should be apparent to those skilled in the art that the size represented in FIGS. 3A and 3B is for illustration only and not indicative of actual casting shrinkage. Comparision of FIGS. 3A and 3B shows that casting passage 85 is substantially reduced in FIG. **3*a* and substantially increased in FIG. 3B. In accordance with an important aspect of the present invention, it should be noted that, notwithstanding the substantial size accommodation represented by the positions of cooling plates 81 through 84 in FIGS. 3A and 3B, the contact of plate edges 86, 90, 92, and 94 with cooling surfaces 95, 91, 93, and 89** respectively is maintained.

With simultaneous reference to FIGS. 2 and 3A and 3B, it should be noted that in accordance with an important aspect of the present invention, each of cooling plates 81 through 84 is moveable under the action of the hydraulic cylinders of the present invention aftercooler without disturbing the integrity of casting passage 85. For example, cooling plate 81 may be moved inwardly under the influence of hydraulic cylinder 75 with interfering with the integrity of casting passage 85 because plate edge 86 is a precision edge and therefore maintains its sealing contact with the flat cooling surface 95 as cooling plate 81 is moved inwardly. Correspondingly, inward motion of cooling plate 81 forces cooling plate 84 to move downwardly, which in turn moves cooling surface 93 with respect to plate edge 92 of cooling plate 83. In the same manner described for plate edge 86 and cooling surface 95, the motion of cooling plate 84 with respect to cooling plate 83 does not disturb the sealing contact of plate edge 92 as it moves across cooling surface 93. In other words, activation of hydraulic cylinder 75 in the inward direction, drives cooling plate 81 downwardly and correspondingly moves cooling plate 84 downwardly, which in turn moves plate edge 86 with respect to cooling surface 95 and plate edge 92 with respect to cooling surface. Because of the precision fit of the cooling surfaces and plate edge, a sealing abutment is maintained between each plate edge and its respective cooling surface notwithstanding the relative motion of any of the plates. In addition, it should be noted that forces in the inward direction applied by hydraulic cylinder 75 against cooling plate 81 which move it inwardly or reduce casting passage 85, also apply a force to plate edge 94 which increases the contact pressure between cooling surface 89 and plate edge 94 of cooling plate 84. Similarly, an inward force applied by hydraulic cylinder 76 causes cooling plate 82 to be forced inwardly reducing casting passage 85. The inward motion of cooling plate 82 moves plate edge 90 across cooling surface 91 and drives cooling plate 81 to the left in FIG. 3A. In similarity to the motion of cooling plate 81, the inward movement of cooling plate 82 causes an increase in the contact pressure between cooling surface 95 and plate edge 86. The precision machining of cooling surface 91 and plate edge 90 ensures that the motion of plate edge 90 across cooling surface 91 does not disturb the sealing contact therebetween and the integrity of casting passage 85 is maintained. By further example, force applied by hydraulic cylinder 79 against cooling plate 83 in the inward direction (that is upward in FIG. 3A) moves cooling plate inwardly and further contracts or reduces casting passage 85. The inward motion of cooling plate 83 moves plate edge 92 across cooling surface 93 with the contact therebetween being maintained as described for cooling plates 81 and 82. In further similarity to the above-described plate motion, the inward motion of plate 83 forces cooling plate 82 upward in FIG. 3A. Finally, the reduction of cross-section of casting passage 85 is completed by an inward force supplied by hydraulic cylinder 80 against cooling plate 84 causing cooling plate 84 to be moved inwardly, moving plate edge 94 with respect to cooling surface 89 and moving cooling plate 83 to the right in FIG. 3A.

As will be apparent from the foregoing discussion, the reduction of casting passage 85 by inward motion of cooling plates 81 through 84 is accomplished without disturbing the sealing contact between the plate edges and the cooling surfaces of the structure. Conversely, and with reference to FIGS. 3B, the area of casting passage 85 may be increased in the reverse manner to a maximum cross-section area such as the situation depicted in FIG. 3B. By reference to FIGS. 3A and 3B, it should be noted that notwithstanding the substantial difference in casting passage 85 depicted in FIGS. 3A and 3B, the sealing engagements of plate edges 86, 90, 92 and 94 with cooling surfaces 95, 91, 93 and 89 respectively, is maintained.

While the foregoing discussions assume simultaneous motion of cooling plates 81 through 84 has occured, it should be apparent to those skilled in the art that the inward motion of each of plates 81 through 84 may be independently undertaken. As a result, and in accordance with an important aspect of the present invention, the motion of cooling plates 81 through 84 may accommodate not only changes in casting cross-sectional area, but also accommodate nonuniformites of the casting which result in bending or twisting of the casting. In other words, if for example, the casting passing through casting passage 85 acquires a curvature causing it to shift to the left in FIG. 3A, cooling plate 84 will be moved to the left in response to the force applied by the casting. At some point this force will be balanced by hydraulic cylinder 80 and the casting surface will contact cooling plate 84. In further response to the curvature and leftward motion of the casting, hydraulic cylinder 76 drives cooling plate 82 to the left direction until cooling surface 95 is brought into contact with the underlying surface of the casting. As a result, the shift of the casting within casting passage 85 to the left, due to curvature of the casting, is compensated for by the motions of cooling plates 82 and 84.

With this understanding of the independent motions of cooling plates 81 through 84 the situation resulting from the above-described taper of casting 51 as it cools may now be addressed. With particular reference to FIG. 2, it should be noted that because plate edges 86, 90, 92 and 94 maintain their respective sealing contacts with cooling surfaces, 95, 91, 93 and 89 regardless of the relative motion therebetween, it should be apparent to those skilled in the art that cooling plates 81 through 84 may be moved by unequal amounts at each end to produce an inclination of one or more of the cooling plates. For example, in the event hydraulic cylinder 75 produces inward deflection against cooling plate 81 which is greater than that produced by hydraulic cylinder 72, cooling plate 81 becomes inclined with respect to frames 70 and 71 such that cooling plate 81 slopes downwardly from the end near frame 70 to the end near frame 71. The inclination of cooling plate 81 thus produced, causes a corresponding inclination of cooling plate 84 because of the above-described coupling of force between cooling surface 89 and plate edge 94. In the event a similar action occurs between hydraulic cylinders 73 and 76 such that hydraulic cylinder 76 produces a greater inward deflection than cylinder 73, cooling plate 82 is angled inwardly (to the left in FIG. 2) from the near frame 70 toward frame 71. The inward inclination of cooling plate 82 causes a corresponding angling of cooling plate 81 to the left. Similarly, a greater inward deflection by hydraulic cylinder 79 than that produced by hydraulic cylinder 74 causes cooling plate 83 to slope upwardly from frame 70 to frame 71. The upward slope of cooling plate 83 in turn causes an upward slope of cooling plate 82. Finally, a greater deflection by hydraulic cylinder 80 than that produced by hydraulic cylinder 77 causes cooling plate 84 to be angled inwardly (to the right in FIG. 2) from frame 70 to 71. The inward or rightward angling of cooling plate 84 causes a corresponding angled motion (to the right) of cooling plate 83. As a result, the cross-sectional area of casting passage 85 at the end proximate to frame 71 is substantially reduced with respect to the other end. In other words, casting passage 85 would taper from a larger cross-section area proximate frame 70 to a reduced cross-section area proximate frame 71. In accordance with an important aspect of the present invention, the ability of the present invention aftercooler to provide a adjustable tapered casting passage permits the contact between the cooling surfaces of each cooling plate and the underlying surfaces of the casting to be maintained over the entire area and most importantly, at the corners of the casting surface.

While the example set forth in FIGS. 2, 3A and 3B is that of a square cross-sectional casting, it will be apparent to those skilled in the art that the present invention may be applied to numerous multi-faceted casting configurations such as triangular, rectangular, pentagonal, hexagonal and so on. In addition, it will be equally apparent to those skilled in the art that the present invention is not limited to castings having symetrical cross-sections but may be adapted to cool castings having irregular cross-sectional shapes.

Accordingly, FIG. 3C sets forth a triangular embodiment of the present invention aftercooler in which a trio of cooling plates 160, 161, and 162 are arranged to define a triangular central passage and support a corresponding trio of cooling surfaces 163, 164, and 165 respectively. Cooling plate 160 defines a sealing edge 166, cooling plate 161 defines a sealing edge 167 and cooling plate 162 defines a sealing edge 168.

FIG. 3D sets forth a hexagonal embodiment of the present invention aftercooler in which six cooling plates 180, 181, 182, 183, 184, and 185 support respective cooling surfaces 186, 187, 188, 189, 190, and 191 and define a hexagonal interior passage. Cooling plates 180 through 185 define respective sealing edges 192 through 197.

The embodiments set forth in FIGS. 3C and 3D function in the same operative manner as the rectangular embodiment shown in FIGS. 3A and 3B.

FIG. 4 sets forth a section view of the horizontal continuous casting system of FIG. 1 taken along section lines 4—4 in FIG. 1. Tundish 13 is coupled to slide gate 15 such that tundish orifice 9 is in substantial alignment with slide gate passage 17. Retainer 20 is secured to slide gate 15 such that the internal passage of retainer 20 and slide gate passage 17 are in substantial alignment. A felt gasket 110 formed of a high temperature resistant material is interposed between copper mold 21 and retainer 20 to affect a fluid tight seal therebetween. Copper mold 21 includes a copper die 18 supported within copper mold 21 which in turn defines an internal die passage 27. A plate recooler 22 defines a pair of cooling plates 37 and 38 supported within plate recooler 22 to provide an extension of die passage 27. Plate recooler 22 is coupled to the serial combination of aftercoolers 10, 11 and 12 which are aligned and supported in accordance with the above-described structure in FIG. 1. Suffice it to note here however, that aftercoolers 10, 11 and 12 are serially mounted and mutually joined to plate recooler 22 such that a continuous casting and cooling passage is formed by die passage 27, the cooling plates including plates 37 and 38 of recooler 22 and the sets of cooling plates in aftercoolers 10, 11 and 12.

As mentioned above, aftercooler 10, comprises a pair of vertical frames 25 and 26 which are joined together by a plurality of cross supports, such as upper cross support 29. Aftercooler 10 includes an upper cooling plate 54 and a lower cooling plate 57. A pair of hydraulic cylinders 100 and 101 are supported within aftercooler 10 and are operative upon cooling plate 54 in accordance with the above-described operation to accommodate casting variations within aftercooler 10. Similarly, aftercooler 10 further includes a pair of hydraulic cylinders 102 and 103 which are operatively coupled to cooling plate 57 to force cooling plate 57 toward the casting as it passes through aftercooler 10 and maintain the cooling contact.

Aftercoolers 11 and 12 are constructed substantially in accordance with aftercooler 10. In accordance with the above-described operation, aftercoolers 11 and 12 maintain the positions of their respective cooling plates by the operation of hydraulic cylinders 104, 105, 106 and 107 in aftercooler 11 and hydraulic cylinders 108, 109, 111 and 112 in aftercooler 12. It should be understood that while only one opposed pair of cooling plates is shown in FIG. 4 for aftercoolers 10, 11 and 12, each has a second plate pair oriented in accordance with the arrangement of FIG. 2 and operated by similar sets of hydraulic cylinders. The operation of aftercooler plates has been amply described above and need not be repeated here. However, suffice it to note here that the surfaces of the cooling plates of aftercoolers 10, 11 and 12 are maintained in contact with the surfaces of casting 52 in a continuous manner from the point at which casting 52 emerges from plate recooler 22.

As mentioned above, the cooling plates of aftercoolers 10, 11 and 12 each define a plurality of coolant passages which are operative to permit the circulation of a coolant therethrough in order to maintain the cooling operation of the cooling plates. By way of overview, a coolant circulating system, described below, circulates coolant through the passages of the aftercooler plates. While portions of the coolant circulating system are not seen in the Figures, it will be apparent to those skilled in the art that any of a number of coolant passage arrangements may be used in practicing the invention so long as there is provided an ample flow of coolant through the aftercooler plates. Accordingly, casting bed 23 defines a coolant input 113 which should be understood to be coupled to a source of cooling fluid which in turn is coupled to a coolant plenum 114. In accordance with the invention, coolant is supplied to coolant input 113 and introduced into coolant plenum 114 under pressure in order to force the coolant through the plurality of cooling passages within the aftercooler structure which circulate coolant through the plates. Accordingly, coolant under pressure in coolant plenum 114 is forced upwardly through passage 115 defined within copper mold 21 and emerges from passage 115 into a plurality of coolant passages defined in plates 37 and 38 which include passages 117 and 118 respectively. It should be understood that passage 115 also supplies coolant to the second set of recooler plates which are not visible in FIG. 4. Thereafter, fluid returns downwardly through passage 119 to a second coolant plenum 120. From coolant plenum 120, coolant is forced upwardly through passage 121 at which point it flows to a passage 122 which emerges on the top portion of aftercooler 10 at passage 123. Coolant thereafter flows from passages 121 and 123 through passages 124 and 125 within cooling plates 54 and 57 as well as the remaining cooling plates of aftercooler 10 (not shown in FIG. 4) and is collected within passages 126 and 128 as well as passage 129. From aftercooler 10 coolant flows into a similar arrangement of cooling passages in aftercooler 11. Most importantly, the coolant flows through passages 135 and 136 of aftercooler 11 to the various coolant passages within the cooling plates of aftercooler 11, such as passages 130 and 131 in cooling plates 59 and 58 respectively. After flowing through the cooling passages of the cooling plates of aftercooler 11, the coolant is then collected in passages 138 and 137 and thereafter flows to the coolant passages of aftercooler 12.

In similar manner to aftercoolers 10 and 11, coolant flows through passages 143 and 142 and thereafter through the plurality of cooling passages within the cooling plates of aftercooler 12 such as passages 132 and 133 of cooling plates 60 and 67 respectively and collects within coolant passage 139 and 140 of aftercooler 12. Thereafter, the coolant combines to flow through passage 141 downwardly from aftercooler 12 and ultimately leaves casting bed 23 through coolant exit port 124.

What has been shown and described is an aftercooler structure which provides a maximum cooling capacity and which maintains optimum cooling of the entire surface of a continuously forming casting notwithstanding substantial variations of casting dimensions and tapers.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. An aftercooler for use in receiving and cooling a continuously cast elongated metal casting, said aftercooler comprising:

a plurality of interengaging walls, having inwardly facing cooling surfaces, which cooperate to form a passageway through which said metal casting passes and which are arranged to engage the periphery of said metal casting, each of said walls defining a plurality of cooling passages in a heat transfer relationship with said cooling surfaces of said walls, said walls being supported so as to permit said walls to move relative to each other to adjust the cross-sectional size of said passageway so as to maintain contact between all portions of the periphery of said metal casting and said cooling surfaces of said walls and thereby compensate for shrinkage of said metal casting as it cools;

each of said interengaging walls defining a first end having a sealing edge configured to sealingly contact the cooling surface of the adjacent wall thereto and a second end and wherein said walls are arranged relative to each other such that each wall contacts a first adjacent wall on one side through the abutment of its sealing edge with the cooling surface of such first adjacent wall and contacts a second adjacent wall on the other side by the abutment of its cooling surface with the sealing edge of the second adjacent wall on the other side;

cooling means for circulating a cooling fluid through said pluralities of cooling passages; and force means for causing said walls to be moved inwardly to contact said casting and to maintain contact with the entire periphery of said metal casting as it passes through said passageway.

2. An aftercooler as set forth in claim 1 wherein said metal casting defines a polyhedron having a plurality of planar exterior surfaces and wherein said plurality of walls correspond in number and arrangement to said exterior surfaces and each of said cooling surfaces is maintained in contact with one of said exterior surfaces.

3. An aftercooler as set forth in claim 1 wherein said metal casting defines a rectangular cross-section and wherein said plurality of walls define four walls and said passageway defines a rectangular cross-section corresponding to said rectangular casting.

4. An aftercooler as set forth in claim 2 wherein said metal casting defines a triangular cross-section and wherein said plurality of walls define three walls and said passageway defines a triangular cross-section corresponding to said triangular casting.

5. A aftercooler as set forth in claim 2 wherein said metal casting defines a hexagonal cross-section and wherein said plurality of walls define six walls and said passageway defines a hexagonal cross-section corresponding to said hexagonal casting.

6. An aftercooler as set forth in claim 5 wherein said walls each define first and second ends and wherein said force means include:

a first plurality of hydraulic cylinders operative upon said first ends of said walls and second plurality of hydraulic cylinders operative upon said second ends of said walls; and means for causing said first and second pluralities of hydraulic cylinders to move said first ends of said walls inwardly a greater distance than said second ends of said walls and cause said passageway to assume a taper.

7. An aftercooler as set forth in claim 1 further including spring means coupled to and operative upon said walls to urge said walls outwardly to tend to expand said passageway and wherein said force means are operative to overcome said urging of said spring means.

8. An aftercooler as set forth in claim 1 wherein each of said hydraulic cylinders are independently operable.

9. An aftercooler as set forth in claim 6 wherein each of said hydraulic cylinders are operated from a common source of pressurized hydraulic fluid.

10. An aftercooler as set forth in claim 6 further including a third plurality of hydraulic cylinders coupled to and operative upon said walls to urge said walls outwardly to expand said passageway.

11. For use in a continuous casting system in which an elongated metal casting is formed within a cooled mold and emerges therefrom having a solidified outer skin and a molten interior, an aftercooler comprising:

a plurality of moveable walls, encircling said elongated casting, each defining a cooling surface and including a first end having a sealing edge configured to sealingly contact the cooling surface of the adjacent wall thereto and a second end, said walls being arranged relative to each other such that each wall contacts a first adjacent wall on one side through the abutment of its sealing edge with the cooling surface of such first adjacent wall and contacts a second adjacent wall on the other side through the abutment of its cooling surface with the sealing edge of such second adjacent wall.

* * * * *